US006551166B1

(12) United States Patent
Myers

(10) Patent No.: US 6,551,166 B1
(45) Date of Patent: Apr. 22, 2003

(54) HEAT RETAINING STUFFED DOLL ASSEMBLY

(76) Inventor: Karla K. Myers, P.O. Box 5674, Chubbuck, ID (US) 83202-0007

( * ) Notice: Subject to any disclaimer, the term of this patent is extended or adjusted under 35 U.S.C. 154(b) by 0 days.

(21) Appl. No.: 10/122,909

(22) Filed: Apr. 12, 2002

(51) Int. Cl.[7] ..... A63H 3/02
(52) U.S. Cl. ..... 446/227; 446/369; 446/385
(58) Field of Search ..... 446/227, 369, 446/370, 371, 372, 385; 215/13.1; 219/201

(56) References Cited

U.S. PATENT DOCUMENTS 1,558,278 A 10/1925 Phillips
1,896,663 A 2/1933 Collins
4,590,633 A * 5/1986 Pickens ..... 5/482
4,694,829 A 9/1987 Frye
4,714,445 A * 12/1987 Templeton ..... 446/74
D316,735 S 5/1991 Burnette et al.
5,993,480 A 11/1999 Burrows
6,019,659 A 2/2000 Walters
6,267,638 B1 * 7/2001 Connolly et al. ..... 446/73
6,325,695 B1 * 12/2001 Weiner ..... 446/369

* cited by examiner

*Primary Examiner*—Jacob K. Ackun

(57) ABSTRACT

A heat retaining stuffed doll assembly for providing a heating device that is attractive, safe, and desirable for use by children. The heat retaining stuffed doll assembly includes a heat retaining material enclosed by a casing member, an outer skin enveloping said casing, the outer skin having an appearance of a predetermined form attractive to children.

9 Claims, 2 Drawing Sheets

HEAT RETAINING STUFFED DOLL ASSEMBLY

BACKGROUND OF THE INVENTION

1. Field of the Invention

The present invention relates to personal heating devices and more particularly pertains to a new heat retaining stuffed doll assembly for providing a heating device that is attractive, safe, and desirable for use by children.

2. Description of the Prior Art

The use of personal heating devices is known in the prior art. U.S. Pat. Nos. 1,896,663, 6,019,659, and 1,558,278 each disclose a stuffed animal or doll having an electronic heating element. U.S. Pat. No. 5,993,480 discloses a microwaveable heating device having a tubular body. U.S. Pat. No. 4,694,829 discloses a stuffed animal having a pocket for receiving a removable packet filled with a liquid or gel having a boiling point higher than water and a freezing point lower than water. U.S. Pat. No. Des. 316,735 shows an ornamental appearance of a doll and pillow carrying case combination.

While these devices fulfill their respective, particular objectives and requirements, the need remains for a non-electric heat retaining doll that is attractive for use by children.

SUMMARY OF THE INVENTION

The present invention meets the needs presented above by providing an enclosed heat retaining material that is heatable using existing means such as a microwave oven and an outer skin that has a pre-determined appearance such as that of a baby wrapped in a blanket.

Still yet another object of the present invention is to provide a new heat retaining stuffed doll assembly that provides an interior casing and an outer skin, each enclosing the heat retaining material to minimize spillage of the heat retaining material from the doll assembly.

Even still another object of the present invention is to provide a new heat retaining stuffed doll assembly that includes an interior casing that has defined chambers to facilitate folding of the body of the doll and even distribution of the heat retaining material through the doll structure.

To this end, the present invention generally comprises a heat retaining material enclosed by a casing member, an outer skin enveloping said casing, the outer skin having an appearance of a pre-determined form attractive to children.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
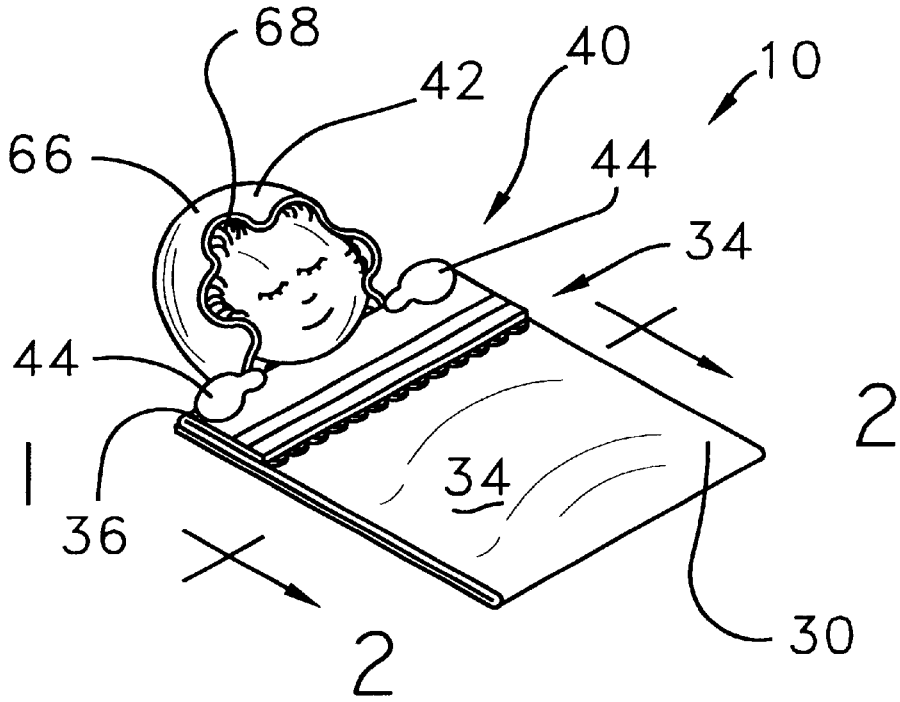
FIG. 1 is a perspective view of a new heat retaining stuffed doll assembly according to the present invention.
Figure 2:
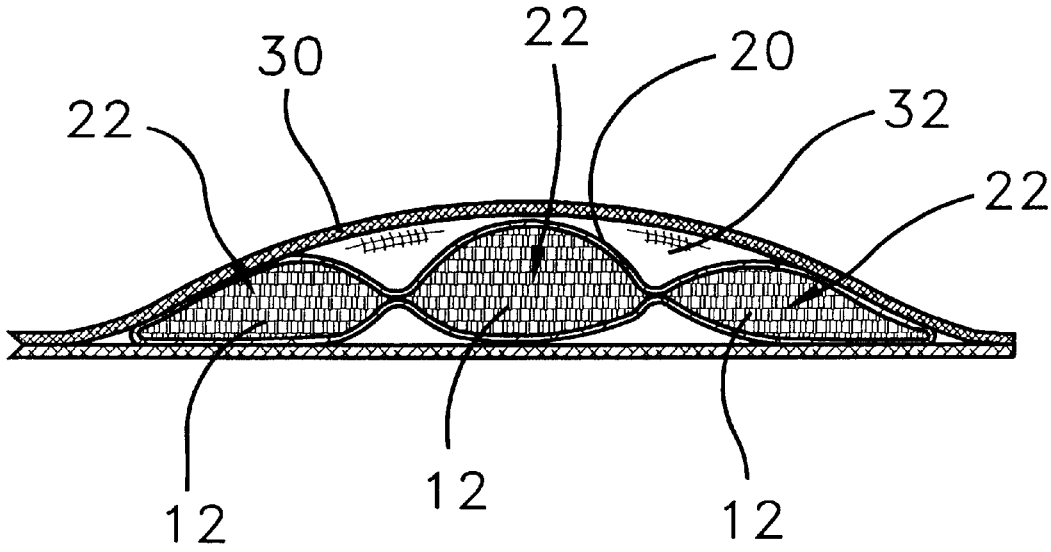
FIG. 2 is a cross-sectional view of the present invention taken along line 2—2 of FIG. 1.
Figure 3:
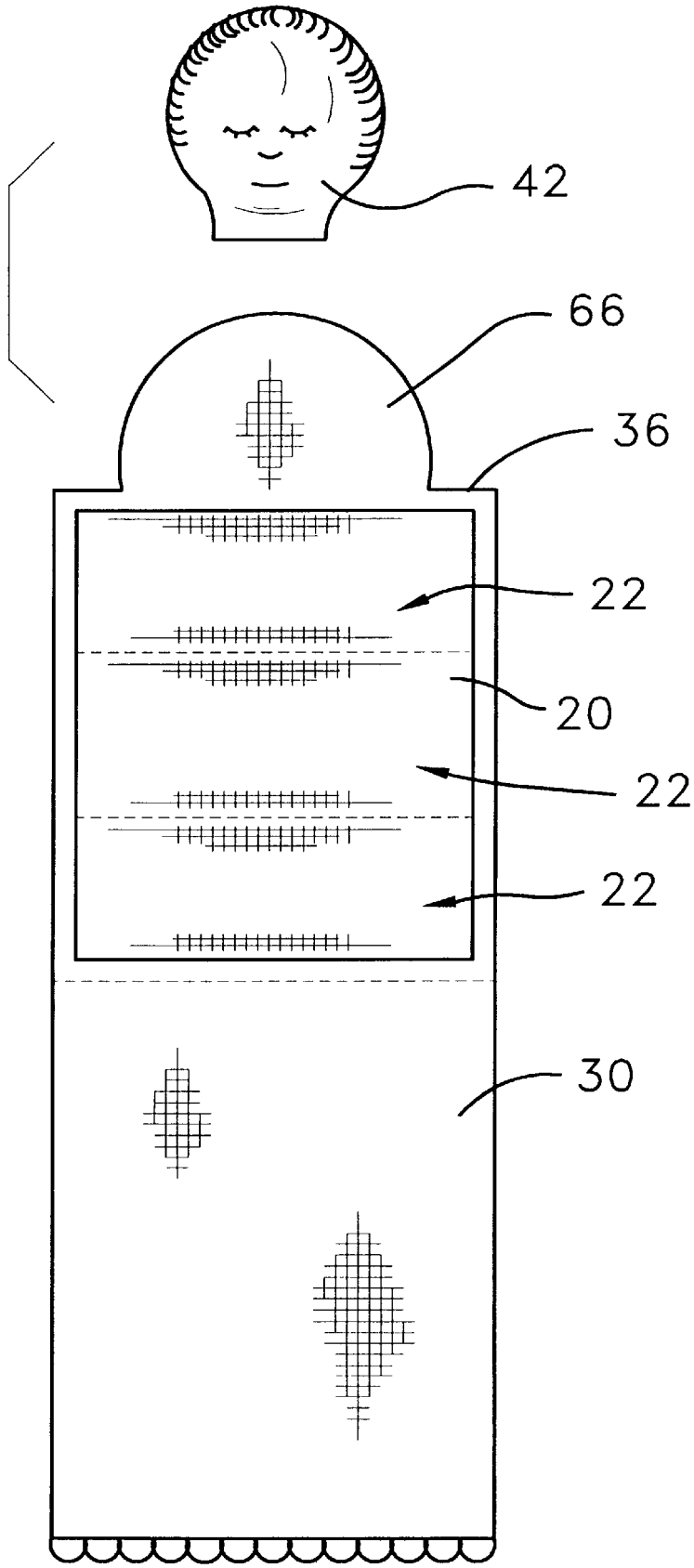
FIG. 3 is a top view of the present invention partially disassembled to show the interior structure of the assembly.

With reference now to the drawings, and in particular to FIGS. 1 through 3 thereof, a new heat retaining stuffed doll assembly embodying the principles and concepts of the present invention and generally designated by the reference numeral 10 will be described.

As best illustrated in FIGS. 1 through 3, the heat retaining stuffed doll assembly 10 generally comprises a heat retaining material 12, preferably a quantity of dry rice. A casing 20 encloses the dry rice 12 such that the dry rice 12 is prevented from escaping from the casing 20. An outer skin 30 has an interior 32 and encloses the casing 20 such that the casing 20 is prevented from being removed from the interior 32 of the outer skin 30. Thus, the dry rice 12 is enclosed by two separate layers to make the doll assembly 10 more durable and prevent spillage of the dry rice 12.

The outer skin 30 forms a body portion 34 of a doll 40. A stuffed head portion 42 is attached to the outer skin 30.

In an embodiment, the outer skin 30 has the appearance of a blanket 34 covering a body of a child. The head portion 42 is positioned such that the head portion 42 appears to be uncovered by the blanket 34. A pair of hand portions 44 are coupled to the outer skin 30 on either side of the head portion 42 such that the hand portions 44 appear to be gripping an edge 36 of the blanket 34.

The casing 20 has a plurality of interior chambers 22. Each of the chambers 22 is sealed off with respect to the other interior chambers 22 thus preventing movement of dry rice 12 between interior chambers 22. The dry rice 12 is dispersed through the interior chambers 22 to facilitate spreading of the dry rice 12 throughout the casing 20 during use. In an embodiment, the interior chambers 22 are three elongate chambers. The elongate chambers 22 are aligned such that longitudinal axes of the elongate chambers 22 are parallel to each other to facilitate folding of the casing 20 around a body part.

A flap 66 extends from the edge 36 of the outer skin 30. The flap 66 is positioned adjacent to the head portion 42. An outer edge 68 of the flap 66 is coupled to the head portion 42 such that the flap 66 forms a hood over the head portion 42.

In use, the entire doll assembly 10 is insertable into a microwave to heat the dry rice, which retains the heat for an extended time after removal from the microwave. The doll assembly is then usable similar to a heating pad. The desirable decorative appearance of the doll assembly makes use less conspicuous and more comforting to small children in particular.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heat retaining stuffed doll assembly comprising:

a heat retaining material;

a casing enclosing said heat retaining material such that said heat retaining material is prevented from escaping from said casing;

an outer skin having an interior, said outer skin enclosing said casing such that said casing is prevented from being removed from said interior of said outer skin, said outer skin having a decorative appearance;

said outer skin forming a body portion of a doll;

a stuffed head portion attached to said outer skin;

said outer skin having an appearance of a blanket covering a body of a child, said head portion being positioned such that said head portion appears to be uncovered by said blanket; and a pair of hand portions, each of said hand portions being coupled to said outer skin such that said hand portions appear to be gripping an edge of said blanket.

2. The heat retaining stuffed doll assembly of claim 1 wherein said heat retaining material is dry rice.

3. The heat retaining stuffed doll assembly of claim 1, further comprising:

said casing having a plurality of interior chambers, each of said chambers being sealed off with respect to other of said interior chambers, said heat retaining material being dispersed through said interior chambers to facilitate spreading of said heat retaining material throughout said casing during use.

4. The heat retaining stuffed doll assembly of claim 3, further comprising:

said interior chambers being three elongate chambers, said elongate chambers being aligned such that longitudinal axes of said elongate chambers are parallel to each other.

5. A heat retaining stuffed doll assembly comprising:

a heat retaining material;

a casing enclosing said heat retaining material such that said heat retaining material is prevented from escaping from said casing;

an outer skin having an interior, said outer skin enclosing said casing such that said casing is prevented from being removed from said interior of said outer skin, said outer skin having a decorative appearance;

said outer skin forming a body portion of a doll;

a stuffed head portion attached to said outer skin;

said outer skin having an appearance of a blanket covering a body of a child, said head portion being positioned such that said head portion appears to be uncovered by said blanket; and a flap extending from an edge of said outer skin, said flap being positioned adjacent to said head portion, an outer edge of said flap being coupled to said head portion such that said flap forms a hood over said head portion.

6. The heat retaining stuffed doll assembly of claim 5 wherein said heat retaining material is dry rice.

7. The heat retaining stuffed doll assembly of claim 5, further comprising:

said casing having a plurality of interior chambers, each of said chambers being sealed off with respect to other of said interior chambers, said heat retaining material being dispersed through said interior chambers to facilitate spreading of said heat retaining material throughout said casing during use.

8. The heat retaining stuffed doll assembly of claim 7, further comprising:

said interior chambers being three elongate chambers, said elongate chambers being aligned such that longitudinal axes of said elongate chambers are parallel to each other.

9. A heat retaining stuffed doll assembly comprising:

a quantity of dry rice;

a casing enclosing said dry rice such that said dry rice is prevented from escaping from said casing;

an outer skin having an interior, said outer skin enclosing said casing such that said casing is prevented from being removed from said interior of said outer skin, said outer skin having a decorative appearance;

said outer skin forming a body portion of a doll; and a stuffed head portion attached to said outer skin;

said outer skin having an appearance of a blanket covering a body of a child, said head portion being positioned such that said head portion appears to be uncovered by said blanket;

a pair of hand portions, each of said hand portions being coupled to said outer skin such that said hand portions appear to be gripping an edge of said blanket;

said casing having a plurality of interior chambers, each of said chambers being sealed off with respect to other of said interior chambers, said dry rice being dispersed through said interior chambers to facilitate spreading of said dry rice throughout said casing during use;

said interior chambers being three elongate chambers, said elongate chambers being aligned such that longitudinal axes of said elongate chambers are parallel to each other; and a flap extending from an edge of said outer skin, said flap being positioned adjacent to said head portion, an outer edge of said flap being coupled to said head portion such that said flap forms a hood over said head portion.

* * * * *